US007832563B2

(12) United States Patent
Dehlin

(10) Patent No.: US 7,832,563 B2
(45) Date of Patent: Nov. 16, 2010

(54) PACKAGE AND INSERT ADAPTED TO FORM PART OF A PACKAGE

(75) Inventor: Marcus Dehlin, Hammaro (SE)

(73) Assignee: Stora Enso AB, Falun (SE)

( * ) Notice: Subject to any disclaimer, the term of this patent is extended or adjusted under 35 U.S.C. 154(b) by 0 days.

(21) Appl. No.: 12/599,492

(22) PCT Filed: Jan. 25, 2008

(86) PCT No.: PCT/SE2008/000069

§ 371 (c)(1),
(2), (4) Date: Nov. 9, 2009

(87) PCT Pub. No.: WO2008/140369

PCT Pub. Date: Nov. 20, 2008

(65) Prior Publication Data

US 2010/0236944 A1 Sep. 23, 2010

(30) Foreign Application Priority Data

May 10, 2007 (SE) ..... 0701123

(51) Int. Cl.
*B65D 5/38* (2006.01)
*B65D 5/43* (2006.01)

(52) U.S. Cl. ..... 206/528; 206/1.5; 206/807; 229/125.125; 229/102; 220/270

(58) Field of Classification Search ..... 206/528, 206/532, 535, 536, 538, 1.5, 807, 531; 229/102, 229/125.125, 913; 220/8, 281, 265, 266, 220/270

See application file for complete search history.

(56) References Cited

U.S. PATENT DOCUMENTS

| | | | | |
|---|---|---|---|---|
| 3,782,584 | A * | 1/1974 | Swenson et al. | 220/345.3 |
| 3,788,517 | A * | 1/1974 | Eannarino et al. | 221/154 |
| 4,648,509 | A * | 3/1987 | Alves | 229/164.1 |
| 5,275,291 | A * | 1/1994 | Sledge | 206/531 |
| 5,511,665 | A | 4/1996 | Dressel et al. | |

(Continued)

FOREIGN PATENT DOCUMENTS

| | | |
|---|---|---|
| EP | 1002744 | 5/2000 |
| EP | 1447109 | 8/2004 |

(Continued)

OTHER PUBLICATIONS

International Search Report and Written Opinion of the International Searching Authority, mailed Jul. 9, 2008, for International Application No. PCT/SE2008/000069.

*Primary Examiner*—Jacob K Ackun, Jr.

(57) ABSTRACT

The disclosure relates to a package comprising a sleeve and an insert, the insert being adapted to be movably received in said sleeve, wherein the package further comprises a locking mechanism adapted to limit unintentional movement of the insert in relation to the sleeve, the insert being provided with a grip portion being accessible to a user, wherein the grip portion is separable from the insert, and wherein the grip portion is adapted to be separated from the insert or made inoperable by application of a first force, wherein the locking mechanism is adapted to withstand said movement of the insert against application of a second force, and wherein the second force is greater than the first force. The disclosure further relates to an insert adapted to form part of a package of the above kind.

8 Claims, 5 Drawing Sheets

U.S. PATENT DOCUMENTS

| | | | | |
|---|---|---|---|---|
| 6,349,831 | B1 * | 2/2002 | Buss | 206/531 |
| 6,491,211 | B1 | 12/2002 | Evans et al. | |
| 6,896,137 | B2 * | 5/2005 | McHutchinson | 206/528 |
| 2003/0189048 | A1 * | 10/2003 | Luburic | 220/276 |
| 2005/0145530 | A1 * | 7/2005 | Gelardi | 206/528 |
| 2006/0131205 | A1 | 6/2006 | Sandberg et al. | |
| 2007/0045149 | A1 | 3/2007 | Hession | |

FOREIGN PATENT DOCUMENTS

| | | |
|---|---|---|
| GB | 19123176 | 11/1912 |
| GB | 292686 | 6/1928 |
| GB | 1276702 | 6/1972 |
| JP | 2002225844 | 8/2002 |
| WO | 2005049438 | 6/2005 |
| WO | 2006068602 | 6/2006 |

* cited by examiner

PACKAGE AND INSERT ADAPTED TO FORM PART OF A PACKAGE

This application is a U.S. National Stage under 35 U.S.C. §371 of International Application No. PCT/SE2008/000069, filed Jan. 25, 2008, which claims priority from Swedish Patent Application No. 0701123-2, filed May 10, 2007.

FIELD OF THE INVENTION

The invention relates to a package comprising a sleeve and an insert, the insert being adapted to be movably received in said sleeve, wherein the package further comprises a releasable locking mechanism adapted to control movement of the insert in relation to the sleeve, the insert being provided with a grip portion being accessible to a user when the insert is received in the sleeve.

The present invention also relates to an insert adapted to be movably and lockably received in a sleeve, wherein the insert further comprises a locking mechanism which is adapted to, in co-operation with a releasable locking mechanism of said sleeve, control movement of the insert in relation to the sleeve, the insert being provided with a grip portion being accessible to a user when the insert is received in a sleeve.

The present invention is especially suitable for, but not limited to, controlled easy-access package for child resistant, senior-friendly storage of unit dose products or the like, carried by a blister card.

TECHNICAL BACKGROUND

U.S. Pat. No. 6,491,211 B1 discloses a child resistant carton assembly comprising a package and a tray slidably receivable within the package. The package comprises a top panel and a locking panel arranged in parallel with and at a distance from the top panel, thereby forming a locking chamber together with the top panel. The tray includes a locking panel arranged at the leading edge (leading when the tray is pushed into the package and trailing when the tray is pulled out of the package). The panel is refolded such that a portion of the tab extends into the locking chamber. The package is provided with a cut-out forming a push-button. If the user pulls the tray outwardly without pushing the push-button, the locking panel will enter the locking chamber thereby blocking removal. By pushing the push-button before the tray is pulled out of the package, the user may release the locking panel such that the tray may be pulled out of the package without, the locking panel entering the locking chamber. If the locking panel has been released the tray may be removed completely from the package.

EP 1 002 744 A1 discloses a two-piece paperboard container that houses a unit dose product on an internal slide card within an outer paperboard shell. This package has two internal locks that prevent the slide card from being pulled out without triggering a lock release mechanism. This package is focused on providing a child resistant, senior-friendly unit dose package that can be opened and closed numerous times and then finally disposed of.

When a user pulls the slide card, a tab of the slide card will be forced into a through-going opening in an inner top panel thereby blocking the slide card from being pulled out of the package. However, if the user pushes a push-button before starting to pull the slide card out of the package, the tab will be pushed out of the through-going opening and the slide card may be pulled out of the package.

WO2006/068602 A1 discloses a package comprising a sleeve and an insert adapted to be slidably received in the sleeve. The insert is provided with one or more flaps providing a first locking means adapted to interact with a first locking means of the sleeve. In the two basic embodiments disclosed in this document, the flaps forming the first locking means are refolded back over the insert about a line extending basically along the sliding direction along which the insert is slidable within the sleeve. These flaps of the first locking means are adapted to interact with a bridge or arc having different shapes in the two basic embodiments.

U.S. Pat. No. 5,511,665 discloses a child-resistant package for medicaments and non-medicaments which is resistant to being opened by a young child because the package challenges the cognitive skills of the child. The package comprises two layers of tear-resistant material which are sealed together except in a central pouch area which contains the packaged item. The package includes a fold line located within an inordinately wider seal area to assist elderly or handicapped persons to grasp and manipulate the package. A tear notch extends across the fold line. The package can be opened only by folding along the fold line and then tearing the package along the tear notch. If the package is not folded along the fold line, the tear notch will not be exposed. The package also preferably includes a tear strip which extends between the tear notch and the contents of the package. If a child tears the package along the tear strip, the tear notch is removed. The package is thereby disarmed and prevented from being opened. The package may include additional fold lines that do not have a tear notch. If a child folds the package along one of these superfluous fold lines and attempts to tear, there will be no notch to initiate the tear, and the package cannot be opened. This package is however difficult to open for elderly or physically impaired persons. Moreover, the design may only be used for single opening of packages.

There is a general desire within this field of applications of packages to make the secure but still make them simple to open.

SUMMARY OF INVENTION

It is an object of the invention to provide a package that is secure from unintentional opening and still is simple to open when handled correctly.

The above object has been achieved with a package comprising a sleeve and an insert, the insert being adapted to be movably received in said sleeve, wherein the package further comprises a releasable locking mechanism adapted to control movement of the insert in relation to the sleeve, the insert being provided with a grip portion being accessible to a user when the insert is received in the sleeve, wherein the grip portion is adapted to be separated from the insert or made inoperable if a force applied to the grip portion reaches a first level in a direction in which the insert is intended to be at least partly removed from the sleeve, wherein the locking mechanism is able to withstand movement of the insert in said direction against application of said force at a level exceeding the first level.

A person, such as a child, being unaware of the correct manner of opening the package will try open the package without realising that the locking mechanism should be released before the insert is pulled out of the sleeve. When the pulling force reaches a first level the grip portion will be torn off from the insert since the locking mechanism is designed such that it is able to withstand the application of a force at a level exceeding the level of the force at which the grip portion is torn off from the insert. In short, the grip portion should break before the locking mechanism is broken. The force at which the grip portion is separated from the insert should be great enough not to break when an adult, who is unaware of the correct manner of opening the package, gently tries to pull the insert without necessarily realising that the locking mechanism need to be released. The force required to separate the grip portion should be low enough to cause breakage before a child applies forces great enough to destroy the package to such a degree that the locking mechanism is released. This balancing of a first level sufficient to separate or make the grip portion inoperable compared to the force that the locking mechanism is able to withstand may be accomplished by e.g. providing a comparably weak grip portion and/or providing a comparably strong locking mechanism. The weakening of the grip portion may e.g. be accomplished by providing a perforation or an initial breaking point, such as a notch, a hole or a short cut along the intended breaking line. The weakening may also be accomplished by adhering the grip portion to the insert using a comparably weak adhesive or providing a comparably small adhesion area. The design of the adhesion area may also be such that the adhesion area is strong if the force is applied in the intended direction but is weak if the force is applied in other directions. As discussed above the locking mechanism should be strong enough to withstand a force greater than the force transferred from the insert to the locking mechanism at the level at which the grip portion of the insert is separated or made inoperable. In a first embodiment the grip portion is separated from the insert when the force applied to the grip portion reaches said first level. In another embodiment the grip portion is not completely torn off the insert; instead the grip portion is made inoperable by destroying it or changing the shape such that removal of the insert is made more difficult. The grip portion may e.g. be destroyed in such a manner that the resulting shape of the grip portion acts as an additional locking mechanism making the opening of the package even further difficult. It may also be destroyed in such a manner that the resulting shape is difficult to get hold off.

Preferred embodiments of the invention are apparent from the dependent claims.

The sleeve may be adapted to enclose the insert such that access to the insert is limited and opening of the package is made difficult if the grip portion has been separated from the insert or made inoperable. With this design it is made more secure that, if the grip portion has been torn off or made inoperable, it is even more difficult for a child to open the package.

The package may be adapted to be opened and re-closed such that the locking mechanism is re-locked with the grip portion being re-accessible to a user thereby allowing reopenability.

The grip portion may be adapted to be separated from the insert or made inoperable by tearing it away from or apart along one or more perforation lines. This is a design readily achievable for most kinds of package materials. The perforation cuts may be through-going or only extend partly through the material. The depth, length and distances between the cuts may be balanced to create the desired level of weakening of the grip portion.

The grip portion may adapted to be separated from the insert or made inoperable by tearing it away from or apart along one or more adhesive portions. This is a design readily achievable for most kinds of package materials.

In this context it may also be noted that the insert may also be sold as a separate unit adapted to be put into a sleeve thereby forming a package of the kind disclosed above. Medicaments may e.g. be sold in a package comprising several inserts carrying the medicaments in blister cavities. The package of the kind above may be formed of a sleeve in a comparably durable design and choice of material in which the user replaces the insert as the medicaments are used. The insert may also be produced at a separate plant and put into sleeves at another plant thereby forming a package adapted to be used and then disposed of when the product has been removed from the package.

An insert may be adapted to be movably and lockably received in a sleeve, wherein the insert may further comprise a locking mechanism which is adapted to, in co-operation with a releasable locking mechanism of said sleeve, control movement of the insert in relation to the sleeve, the insert being provided with a grip portion being accessible to a user, wherein the grip portion is adapted to be separated from the insert or made inoperable if a force applied to the grip portion reaches a first level in a direction in which the insert is intended to be at least partly removed from the sleeve, wherein the locking mechanism is able to withstand movement of the insert in said direction against application of said force at a level exceeding the first level.

Preferred embodiments of the insert are apparent from the dependent claims. The advantages of the preferred embodiments are discussed in relation to the corresponding features of the package.

BRIEF DESCRIPTION OF THE DRAWINGS

The invention will by way of example be described in more detail with reference to the appended schematic drawings, which shows a presently preferred embodiment of the invention.

DETAILED DESCRIPTION OF PREFERRED EMBODIMENTS

Figure 1:
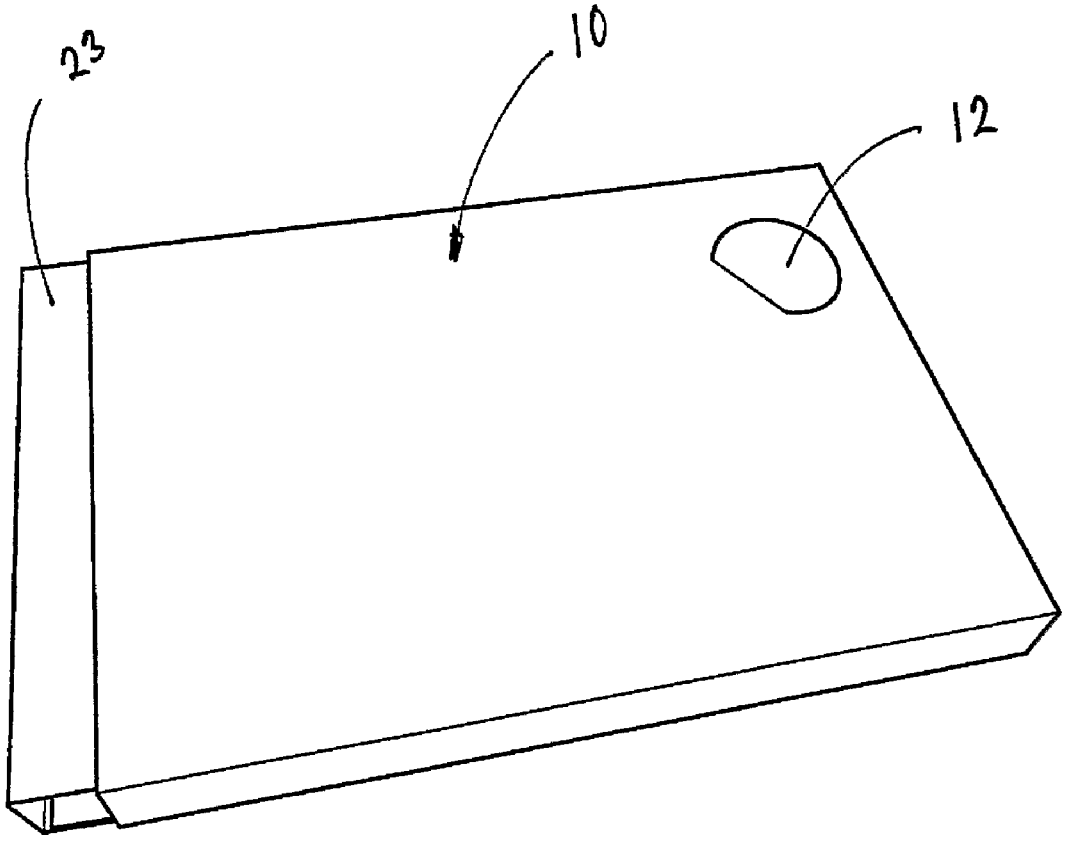
FIG. 1 shows a closed package.
Figure 2:
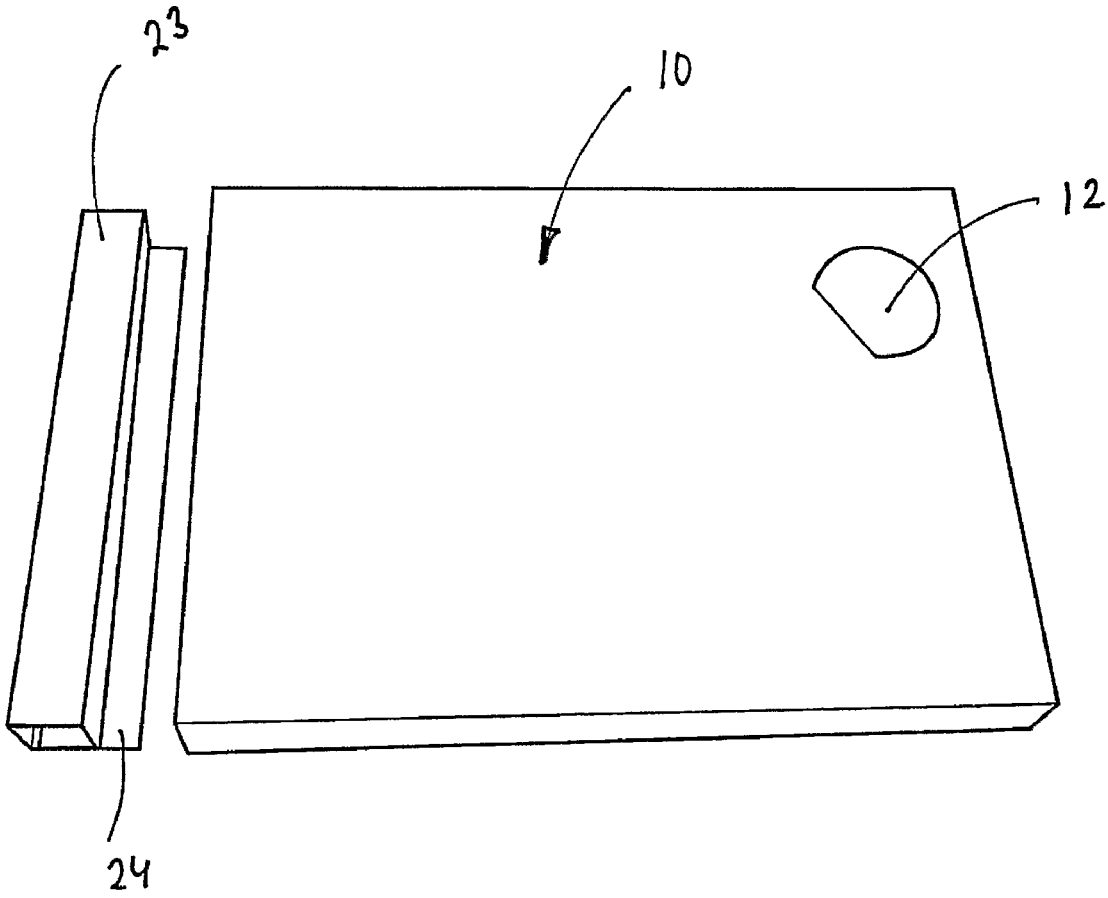
FIG. 2 shows a package where a grip portion has been torn off by a user who has tried to open the package in an incorrect manner.
Figure 3:
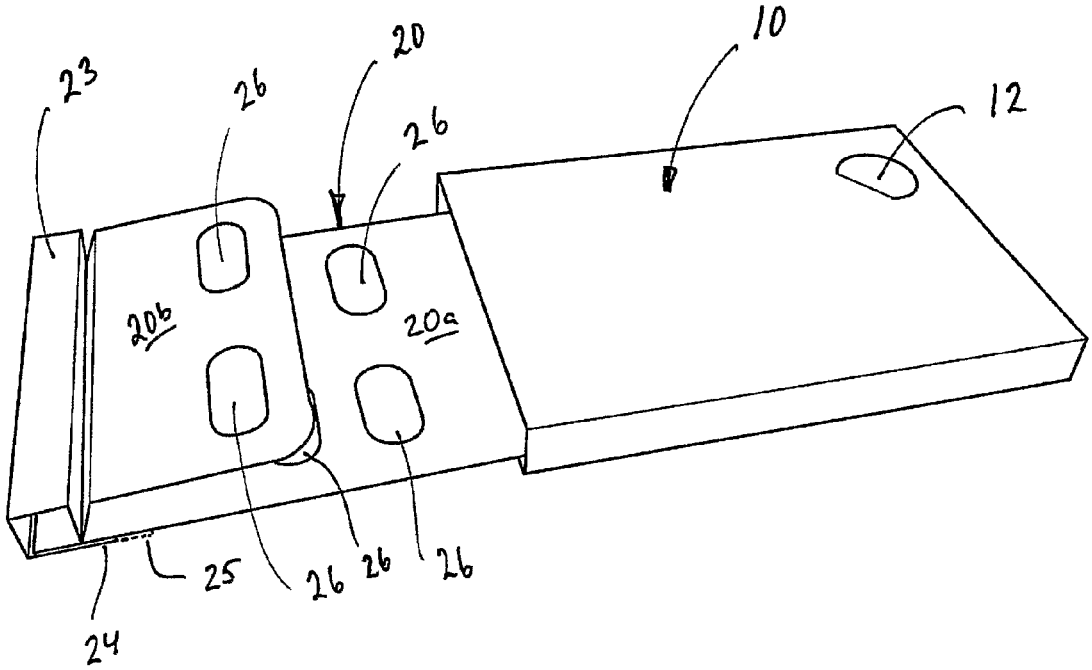
FIG. 3 shows a package that has been opened in a correct manner.
Figure 4:
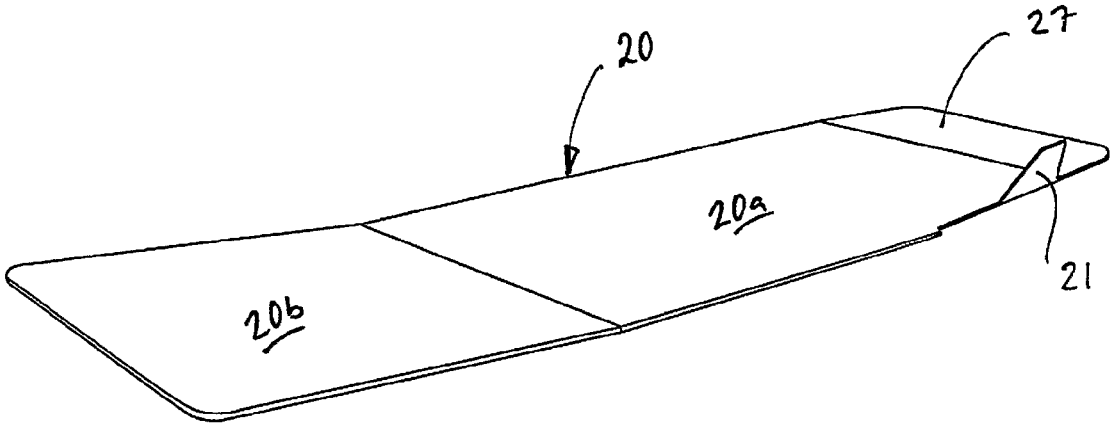
FIG. 4 shows in simplified form an insert with a locking flap.
Figure 5:
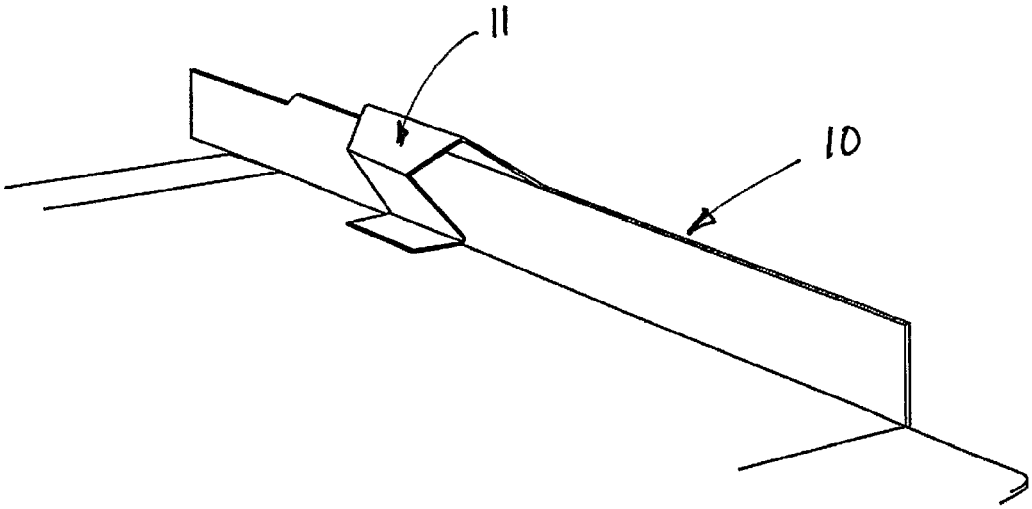
FIG. 5 shows in simplified form a portion of a sleeve provided with a locking flap.
Figure 6:
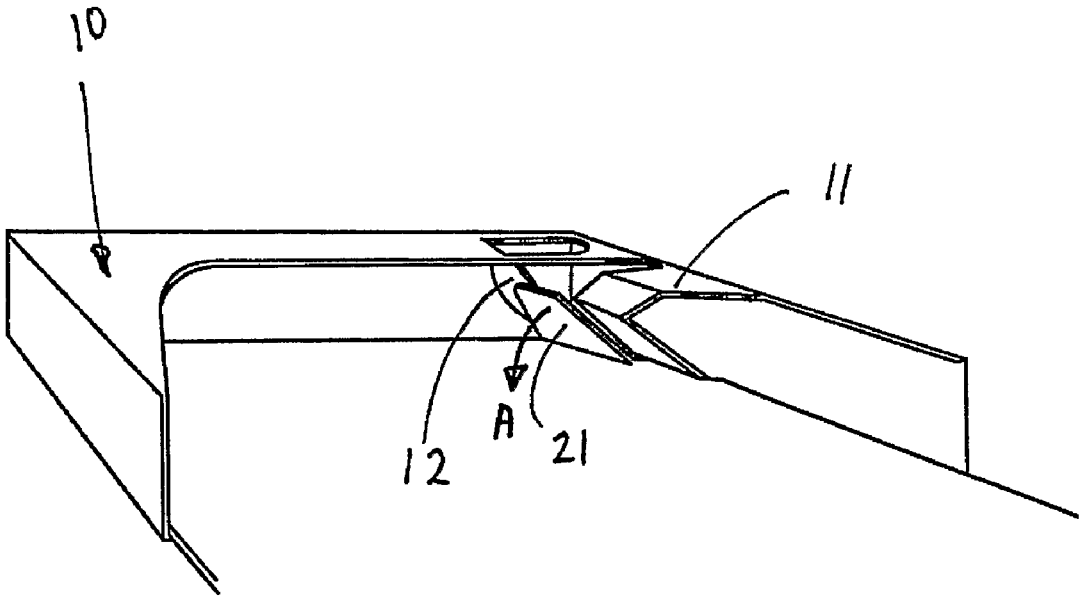
FIG. 6 shows in simplified form a portion of an insert and a sleeve disclosing the interaction of the locking flaps forming the locking mechanism.

As shown in FIGS. 1-3 the package basically comprises a sleeve 10 and an insert 20. The sleeve 10 is formed of a blank with a plurality of panels defined by a plurality of fold lines. The sleeve 10 is folded into a basically parallelepipedic hollow body in which the insert 20 is slidably received. Such a basic configuration is e.g. disclosed in WO2006/068602 A1. The package formed of the sleeve 10 and the insert 20 (and optionally other elements) is provided with a releasable locking mechanism. The locking mechanism comprises, as shown in FIGS. 4-6, a locking flap 21 on the insert 20, a locking flap or locking arc 11 inside the sleeve 10 and a push-button 12 accessible to the user from the outside of the sleeve 10. If user tries to pull the insert 20 out of the sleeve 10 without releasing the locking mechanism removal of the insert is prevented. Only if the user could pull the insert 20 with a force great enough to tear the locking mechanism apart, the insert 20 may be pulled out of the sleeve 10. This is however prevented with the specific design of the insert 20 as will be discussed in detail below. The user may pull the insert 20 out of the sleeve 10 without any problem if the locking mechanism is released before the insert 20 is pulled out. The locking mechanism is released by the user by pushing the push-button 12 inwardly into the sleeve 10. The push-button 12 will interact with the locking flap 21 of the insert 20 such that the locking flap 21 will be folded as indicated by arrow A in FIG. 6. This will make it possible for the locking flap 21 to pass the locking arc 11 as the user pulls the insert 20 out of the sleeve 10. If not released, the locking flap 21 of the insert 20 will not be able to pass the locking arc 11 and removal of the insert 20 from the sleeve 10 is prevented.

The insert 20 is provided with or connected to a grip portion 23. When the insert 20 is slid into the sleeve 10 to such an extent that the locking mechanism locks the insert 20 inside the sleeve 10, the insert 20 is enclosed by the sleeve 10 and not accessible to the user. The grip portion 23 is however accessible to the user when the insert 20 is slid into the sleeve 10 to such an extent that the locking mechanism locks the insert 20 inside the sleeve 10. When opening the package by pulling the insert 20 out of the sleeve 10, the user grips the grip portion 23 and releases the locking mechanism (by manoeuvring the locking flap 21 with the push-button 12) and then pulls the insert 20 out of the sleeve 10. When the user pulls the insert 20 back into the sleeve 10 the package is re-closed such that the locking mechanism is re-locked with the grip portion 23 being re-accessible to the user thereby allowing reopenability. In one embodiment the grip portion 23 is attached to the insert 20 using an adhesive. The grip portion 23 may also be integrally formed with a insert 20.

The grip portion 23 is adapted to be separated from the insert 20 or made inoperable if a user tries too hard to pull the insert 20 out of the sleeve 10 without releasing the locking mechanism. The grip portion 23 is torn off from the insert 20 if the force applied to the grip portion 23 reaches a first level in the direction in which the insert is intended to be pulled out from the sleeve 10. The grip portion 23 is torn off from the insert 10 since the locking mechanism is able to withstand movement of the insert 20 in said direction against application of said force at a level exceeding the first level. Thus, the locking mechanism is stronger than the connection between the grip portion 23 and the remainder of the insert 20.

The breaking point at which or breaking line along which the grip portion 23 is separated from the insert 20 may e.g. be a perforation or an adhesion area. In FIG. 3 the solid lines corresponds to a design where the panel 24 of FIG. 2 is adhesively connected to the underside of the insert 20 and the adhesive properties are chosen such that the panel 24 is torn off from the underside of the insert 20. In FIG. 3 the dotted lines (indicated by 25) represents a design where a fastening panel 25 is adhered to the underside of the insert 20 whereas the panel 24 is connected to the fastening panel 25 via a perforation line but not as such adhered to the underside of the insert 20. It is also contemplated to use a combination of adhesive areas and perforated areas to provide the intended point or line of break. It is also contemplated to design the adhesive areas or perforations such that the grip portion 23 may be pulled with a greater force without breaking if pulled in the correct direction compared to if it is pulled in a direction different from the correct direction. This way a child will have an even greater likelihood to tear the grip portion 23 off while the package will still be comparably durable when used correctly.

The breaking point at which or breaking line along which the grip portion 23 is separated from the insert 20 is preferably not visible to the user when the package is presented to the user in its closed state (with the insert 20 tucked into the sleeve 10). If it would have been visible, there is a risk that the user interprets the visual impact as that he or she should tear off the grip portion at the breaking point or along the breaking line, such as a perforation, before the package can be opened. For similar reason it is in many cases preferred that the breaking point or breaking line is hidden to the user also when the package is opened.

The user is presented with a package as shown in FIG. 1. If the user pulls the grip portion 23 without releasing the locking mechanism the grip portion 23 will eventually be separated from the insert 20. As shown in FIG. 2, the insert 20 is enclosed by the sleeve 10 such that access to the insert 20 is limited and opening of the package is made difficult.

The insert 20 may e.g. be a so-called blister card where unit dose products, such as medicaments, are placed in blister cavities 26.

The sleeve 10 is preferably made of a paperbased or polymerbased laminate structure. The insert 10 is preferably made of a paperbased or polymerbased laminate structure. The blisters 26 are preferably made of a polymerbased material, transparent or opaque.

It is contemplated that there are numerous modifications of the embodiments described herein, which are still within the scope of the invention as defined by the appended claims.

The tearing away or destruction of the grip portion may also be used to disclose to a user if someone else has tried or actually has opened the package before.

The insert 20 may e.g. be prevented from being completely pulled out of the sleeve 10 by making use of the panel 27 as a refolded retaining mechanism co-operating with a opening, panel or arc formed in the sleeve. Alternatively the sleeve 10 may be provided with a second arc (corresponding to the arc 11) located closer to the opening of the sleeve 10. With this design the grip portion 23 must be removed to make it possible to remove the panel 20*b* (which need to be removed to get access to the product).

The invention claimed is:

1. Package comprising a sleeve and an insert, the insert being adapted to be movably received in said sleeve, wherein the package further comprises a releasable locking mechanism adapted to control movement of the insert in relation to the sleeve, the insert being provided with a grip portion being accessible to a user when the insert is received in the sleeve, wherein the grip portion is adapted to be separated from the insert or made inoperable if a force applied to the grip portion reaches a first level in a direction in which the insert is intended to be at least partly removed from the sleeve, wherein the locking mechanism is able to withstand movement of the insert in said direction against application of said force at a level exceeding the first level.

2. Package according to claim 1, wherein the sleeve is adapted to enclose the insert such that access to the insert is limited and opening of the package is made difficult if the grip portion has been separated from the insert or made inoperable.

3. Package according to claim 1, wherein the package is adapted to be opened and re-closed such that the locking mechanism is re-locked with the grip portion being re-accessible to a user thereby allowing reopenability.

4. Package according to, claim 1, wherein the grip portion is adapted to be separated from the insert or made inoperable by tearing it away from or apart along one or more perforation lines.

5. Package according to, claim 1, wherein the grip portion is adapted to be separated from the insert or made inoperable by tearing it away from or apart along one or more adhesive portions.

6. Insert adapted to be movably and lockably received in a sleeve, wherein the insert further comprises a locking mechanism which is adapted to, in co-operation with a releasable locking mechanism of said sleeve, control movement of the insert in relation to the sleeve, the insert being provided with a grip portion being accessible to a user, wherein the grip portion is adapted to be separated from the insert or made inoperable if a force applied to the grip portion reaches a first level in a direction in which the insert is intended to be at least partly removed from the sleeve, wherein the locking mechanism is able to withstand movement of the insert in said direction against application of said force at a level exceeding the first level.

7. Insert according to claim 6, wherein the grip portion is adapted to be separated from the insert or made inoperable by tearing it away from or apart along one or more perforation lines.

8. Insert according to claim 6, wherein the grip portion is adapted to be separated from the insert or made inoperable by tearing it away from or apart along one or more adhesive portions.

* * * * *